US009147509B2

(12) United States Patent
Chu et al.

(10) Patent No.: US 9,147,509 B2
(45) Date of Patent: Sep. 29, 2015

(54) RADIAL-LEADED OVER-CURRENT PROTECTION DEVICE

(71) Applicants: Fu Hua Chu, Taipei (TW); Yi An Sha, New Taipei (TW); En Tien Yang, Zhubei (TW); Tong Cheng Tsai, Tainan (TW)

(72) Inventors: Fu Hua Chu, Taipei (TW); Yi An Sha, New Taipei (TW); En Tien Yang, Zhubei (TW); Tong Cheng Tsai, Tainan (TW)

(73) Assignee: POLYTRONICS TECHNOLOGY CORP., Hsinchu (TW)

( * ) Notice: Subject to any disclaimer, the term of this patent is extended or adjusted under 35 U.S.C. 154(b) by 23 days.

(21) Appl. No.: 14/281,038

(22) Filed: May 19, 2014

(65) Prior Publication Data

US 2015/0155080 A1 Jun. 4, 2015

(30) Foreign Application Priority Data

Nov. 29, 2013 (TW) ..... 102143675 A

(51) Int. Cl.

| | |
|---|---|
| ***H01C 7/02*** | (2006.01) |
| ***H01C 1/14*** | (2006.01) |
| ***H01C 1/144*** | (2006.01) |
| ***H01C 17/065*** | (2006.01) |
| *H01C 1/028* | (2006.01) |

(52) U.S. Cl.

CPC ..... *H01C 1/1406* (2013.01); *H01C 1/144* (2013.01); *H01C 7/027* (2013.01); *H01C 17/0652* (2013.01); *H01C 17/06566* (2013.01); *H01C 1/028* (2013.01)

(58) Field of Classification Search

CPC ..... H01C 1/1406; H01C 7/027; H01C 7/13; H01C 13/02; H01C 17/006; H01C 7/021; H01C 7/02; H01C 17/0652; H01C 17/06526; H01C 17/06566; H01C 1/08; H01C 1/084

USPC ..... 338/22 R, 328, 320, 13, 332, 313, 314

See application file for complete search history.

(56) References Cited

U.S. PATENT DOCUMENTS

| | | | | |
|---|---|---|---|---|
| 6,794,980 | B2 * | 9/2004 | Chu et al. | 338/22 R |
| 7,286,038 | B1 * | 10/2007 | Wang et al. | 338/22 R |
| 2013/0021704 | A1 * | 1/2013 | Tseng et al. | 361/93.8 |
| 2015/0155080 | A1 * | 6/2015 | Chu et al. | 338/22 R |

FOREIGN PATENT DOCUMENTS

| | | |
|---|---|---|
| CN | 1770331 A | 5/2006 |
| TW | I413991 | 11/2013 |

* cited by examiner

*Primary Examiner* — Kyung Lee

(74) *Attorney, Agent, or Firm* — Egbert Law Offices, PLLC

(57) ABSTRACT

A radial-leaded over-current protection device includes a PTC device, first and second electrode leads and an insulating encapsulation layer. The PTC device has first and a second conductive layers and a PTC material layer therebetween. The PTC material layer has a resistivity less than 0.18 Ω-cm and includes crystalline polymer and conductive ceramic filler. The ceramic filler has a resistivity less than 500 Ω-cm and is 35-65% by volume of the PTC material layer. The first electrode lead has an end connecting to the first conductive layer, whereas the second electrode lead has an end connecting to the second conductive layer. The insulating encapsulation layer wraps the PTC device and the ends of the conductive layers. The radial-leaded over-current protection device at 25° C. has a value of hold current thereof divided by an area of the PTC device ranging from 0.027-0.3A/mm$^2$. Each electrode lead has a cross-sectional area of at least 0.16 mm$^2$.

16 Claims, 2 Drawing Sheets

RADIAL-LEADED OVER-CURRENT PROTECTION DEVICE

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present application relates to an over-current protection device, and more particularly to a radial-leaded over-current protection device.

2. Description of Related Art Including Information Disclosed Under 37 CFR 1.97 and 37 CFR 1.98.

Because the resistance of a conductive composite material having positive temperature coefficient (PTC) characteristic is very sensitive to temperature variation, it can be used as the material for current sensing devices, and has been widely applied to over-current protection devices or circuit devices. The resistance of the PTC conductive composite material remains extremely low at a normal temperature, so that the circuit or cell can operate normally. However, when an over-current or an over-temperature event occurs in the circuit or cell, the resistance instantaneously increases to a high resistance state, i.e., trip, so as to suppress over-current and protect the cell or the circuit device.

In general, the PTC conductive composite material contains crystalline polymer and conductive filler. The conductive filler is dispersed uniformly in the crystalline polymer. The crystalline polymer is usually a polyolefin polymer or a fluoropolyolefin polymer such as polyethylene. The conductive filler is usually carbon black.

The electrical conductivity of the PTC conductive composite material depends on the content and type of the conductive filler. In general, the resistivity of the PTC conductive composite material containing the carbon black as the conductive filler is not low enough, and therefore the composite material of large resistivity is not suitably applied to miniature devices. Because carbon black is of relatively low electrical conductivity, a large hold current of the device containing carbon black is hard to be attained. The hold current indicates a maximum current that the PTC device can endure before trip at a specific temperature. To develop a device of a large hold current, conductive filler of a lower resistivity than carbon black has to be used. However, even the PTC conductive composite material of a resistivity below 0.2 Ω-cm may be achieved by using metal conductive filler, it often loses voltage endurance.

With the advancement of miniaturization of devices, it is difficult to further decrease the resistance of a miniature device and sustain large hold current simultaneously. In particular, in an attempt to decrease the entire resistance of the radial-leaded over-current protection device, it has to consider not only the resistance of the PTC device but also the composition, shape and size of the external electrode leads associated with the PTC device.

BRIEF SUMMARY OF THE INVENTION

The present application is to provide a radial-leaded over-current protection device, in which conductive filler of low resistivity and external electrode leads of low resistance are utilized. This enables the radial-leaded over-current protection device to exhibit low resistance and large hold current. The radial-leaded over-current protection device of the present application is suitable for miniaturization and the applications of low resistance and large hold current.

In accordance with an embodiment of the present application, a radial-leaded over-current protection device comprises a PTC device, a first electrode lead and a second electrode lead and an insulating encapsulation layer. The PTC device comprises a first conductive layer, a second conductive layer and a PTC material layer sandwiched between the first and second conductive layers. The PTC material layer has a resistivity less than 0.18 Ω-cm. The PTC material layer comprises crystalline polymer and conductive ceramic filler dispersed therein. The conductive ceramic filler has a resistivity less than 500 Ω-cm and comprises 35% to 65% by volume of the PTC material layer. An end of the first electrode lead connects to the first conductive layer, and an end of the second electrode lead connects to the second conductive layer. The insulating encapsulation layer wraps the PTC device and the ends of the first and second electrode leads connecting to the PTC device. The radial-leaded over-current protection device, at 25° C., indicates that the hold current thereof divided by the area of the PTC device is in the range of 0.027-0.3 A/mm$^2$. When the hold current of the radial-leaded over-current protection device at 25° C. is 0.05-2.4 A, each of the first and second electrode leads has a cross-sectional area of at least 0.16 mm$^2$. When the hold current of the radial-leaded over-current protection device at 25° C. is 2.5-11.9 A, each of the first and second electrode leads has a cross-sectional area of at least 0.5 mm$^2$. When the hold current of the radial-leaded over-current protection device at 25° C. is 12-16 A, each of the first and second electrode leads has a cross-sectional area of at least 0.8 mm$^2$.

In an embodiment, the PTC device has an area less than 300 mm$^2$ and a thickness ranging from 0.2 mm to 2 mm.

In an embodiment, a ratio of the thickness of the PTC device to the total thickness of the first and second conductive layers is about 1-30.

In an embodiment, the radial-leaded over-current protection device has a resistance less than 100 mΩ.

In an embodiment, the hold current is equal to $k1+A\times k2$, where k1=0.9-6 A, k2=0.01-0.03 A/mm$^2$, and A is the area of the PTC device in square millimeters.

In an embodiment, the conductive filler may be titanium carbide (TiC), tungsten carbide (WC), vanadium carbide (VC), zirconium carbide (ZrC), niobium carbide (NbC), tantalum carbide (TaC), molybdenum carbide (MoC), hafnium carbide (HfC), titanium boride ($TiB_2$), vanadium boride (VB2), zirconium boride ($ZrB_2$), niobium boride ($NbB_2$), molybdenum boride ($MoB_2$), hafnium boride ($HfB_2$), zirconium nitride (ZrN), titanium nitride (TiN), or mixture, solid solution, or core-shell structure thereof.

In an embodiment, the breakdown voltage of the radial-leaded over-current protection device divided by the thickness of the PTC device is in the range of 50-100 kV/mm.

In an embodiment, the cross-sectional area of the electrode lead is 0.16-1 $mm^2$.

In an embodiment, the length of electrode lead divided by the cross-sectional area of the electrode lead is 20-300 $mm^{1}$.

In an embodiment, the insulating encapsulation layer comprises a polymer material of which the glass transition temperature is less than the melting point of the crystalline polymer in the PTC material layer.

In an embodiment, the solder for connecting the first and second electrode leads to the first and second conductive layers has a melting point greater than 190° C.

In an embodiment, each of the first and second electrode leads has a resistance less than 3 mΩ.

In an embodiment, the first and second electrode leads use tin-plated copper wire.

In an embodiment, the PTC material layer is subjected to electron-beam or γ-ray irradiation.

In brief, the radial-leaded over-current protection device of the present application uses conductive ceramic filler and electrode leads of low resistance, thereby obtaining hold current value per unit area, low resistivity and good voltage endurance. Therefore, this invention is suitable for the applications of the devices of small size, such as the device of a form factor 1812, 1210, 1206, 0805, 0603 or 0402, or the device of a circular shape with equivalent area.

BRIEF DESCRIPTION OF THE SEVERAL VIEWS OF THE DRAWINGS

The present application will be described according to the appended drawings in which.

DETAILED DESCRIPTION OF THE INVENTION

The making and using of the presently preferred illustrative embodiments are discussed in detail below. It should be appreciated, however, that the present application provides many applicable inventive concepts that can be embodied in a wide variety of specific contexts. The specific illustrative embodiments discussed are merely illustrative of specific ways to make and use the invention, and do not limit the scope of the invention.

Figure 1:
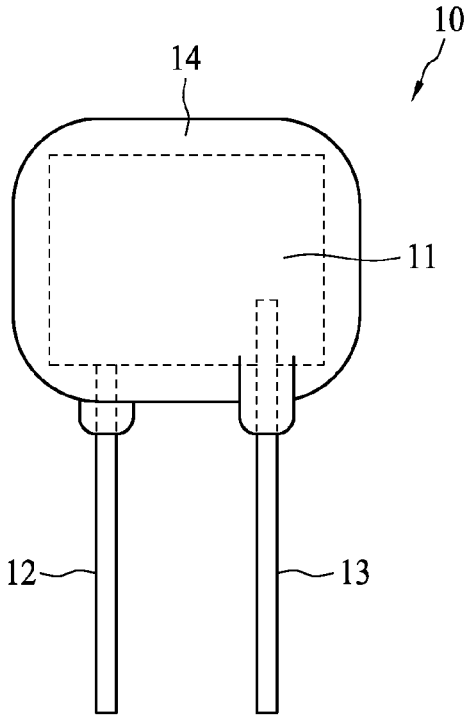
FIGS. 1 and 2 show a radial-leaded over-current protection device in accordance with a first embodiment of the present application.
Figure 2:
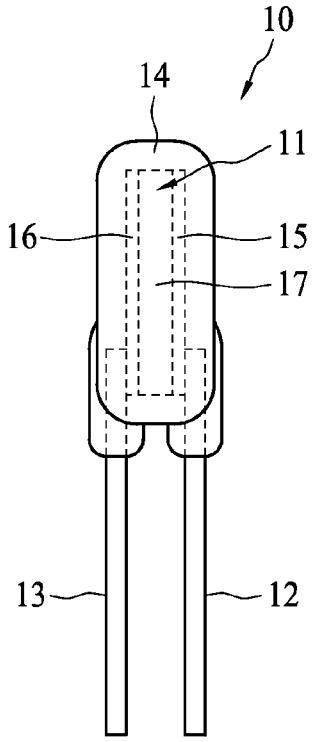

FIG. 1 and FIG. 2 show a radial-leaded over-current protection device in accordance with a first embodiment of the present application. FIG. 2 shows the right-side view of the device in FIG. 1. A radial-leaded over-current protection device 10 comprises a PTC device 11, first and second electrode leads 12 and 13 and an insulating encapsulation layer 14. The PTC device 11 comprises a first conductive layer 15, a second conductive layer 16 and a PTC material layer 17 laminated between the first conductive layer 15 and the second conductive layer 16. In an embodiment, the PTC device 11 (see FIG. 1) has an area less than 300 $mm^2$, 200 $mm^2$ or 100 $mm^2$, and has a thickness in the range 0.2-2 mm.

An end of the first electrode lead 12 connects to the first conductive layer 15, whereas an end of the second electrode lead 13 connects to the second conductive lead 16. The length divided by the area of any one of the first and second electrode leads 12 and 13 is 20-300 $mm^{1}$, and the resistance of any one of the first and second electrode leads 12 and 13 is less than 3 mΩ. The limitation to the resistances of the electrode leads is to avoid excessive resistance of the entire radial-leaded over-current protection device. The PTC device 11 and the ends of the first and second electrode leads 12 and 13 connecting to the PTC device 11 are overlaid by the insulating encapsulation layer 14.

Figure 3:
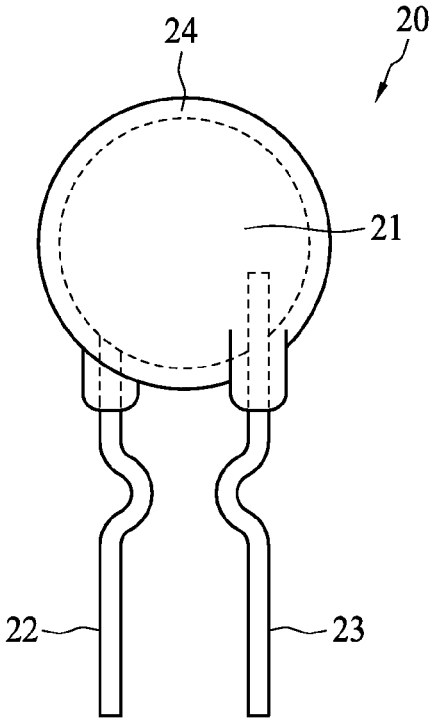
FIGS. 3 and 4 show a radial-leaded over-current protection device in accordance with a second embodiment of the present application.
Figure 4:
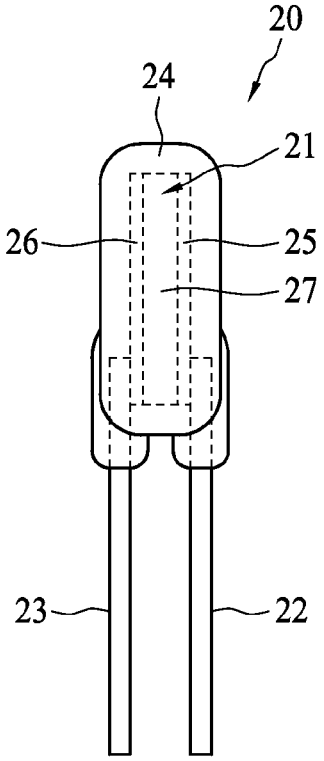

In addition, the radial-leaded over-current protection device in accordance with the second embodiment of the present application is shown in FIG. 3 and FIG. 4, and FIG. 4 is the right-side view of the device in FIG. 3. A radial-leaded over-current protection device 20 comprises a PTC device 21, first and second electrode leads 22 and 23 and an insulating encapsulation layer 24. The PTC device 21 comprises a first conductive layer 25, a second conductive layer 26 and a PTC material layer 27 laminated between the first conductive layer 25 and the second conductive layer 26. Unlike the square shape of the PTC device 11 in FIGS. 1 and 2, the PTC device 21 is in a circular shape. Each of the electrode leads 22 and 23 has a bend as a buffer for installation and positioning.

Table 1 shows the composition of the PTC material layer in accordance with the embodiments of the present application. The PTC material layer essentially comprises crystalline polymer and conductive ceramic filler. The crystalline polymer comprises high-density polyethylene (HDPE), low-density polyethylene (LDPE) and/or polyvinylidene fluoride (PVDF). The conductive ceramic filler comprises titanium carbide and/or tungsten carbide of which the resistivity is less than 500 Ω-cm. Carbon black is used as conductive filler for comparative examples (Comp 1 and Comp 2). Embodiments 3, 8 and 9 (Em 3, Em 8 and Em 9) and Comp 1 and Comp 2 use boron nitride (BN) and magnesium hydroxide ($Mg(OH)_2$) as flame retardant, respectively. The crystalline polymer comprises 35-65% by volume of the composition, and it may comprise 40%, 45%, 50% or 55 by volume in particular. Conductive ceramic filler may comprise 35-65% by volume of the composition, and it may comprise 40%, 45%, 50% or 55 by volume in particular.

TABLE 1

| | Composition (vol %) | | | | | | | |
|---|---|---|---|---|---|---|---|---|
| | HDPE | LDPE | PVDF | WC | TiC | CB | BN | $Mg(OH)_2$ |
| Em 1 | 55.3 | — | — | 44.7 | — | — | — | — |
| Em 2 | 42 | — | — | — | 58 | — | — | — |
| Em 3 | 39.2 | 10.1 | — | 34.8 | — | 10 | 5.9 | — |
| Em 4 | 8.8 | 24.8 | 6.7 | — | 59.7 | — | — | — |
| Em 5 | 42 | — | — | — | 58 | — | — | — |
| Em 6 | — | — | 60.5 | 39.5 | — | — | — | — |
| Em 7 | 43.1 | — | — | — | 56.9 | — | — | — |
| Em 8 | — | — | 53.9 | 43.5 | — | — | 2.6 | — |
| Em 9 | — | — | 53.9 | 43.5 | — | — | 2.6 | — |
| Comp 1 | 60 | — | — | — | — | 35 | — | 5 |
| Comp 2 | 60 | — | — | — | — | 35 | — | 5 |

The manufacturing method of the radial-leaded over-current protection device of the present application is given below. The people having ordinary knowledge can implement substantially equivalent or similar process to make the devices or the like. First, the raw material is set into a blender (Haake-600) at 160° C. for 2 minutes. The procedures of feeding the material are as follows: Crystalline polymer is first loaded into the Haake blender, and the conductive filler is then added into the blender. The rotational speed of the blender is set to 40 rpm. After blending for three minutes, the rotational speed increases to 70 rpm. After blending for seven minutes, the mixture in the blender is drained and thereby a PTC conductive composition is formed. Afterward, the above conductive composition is loaded into a mold to form a symmetrical PTC lamination structure with the following layers: steel plate/Teflon cloth/nickel foil/PTC compound (i.e., the conductive composition)/nickel foil/Teflon cloth/steel plate. The mold loaded with the conductive composition is pre-pressed for three minutes at 50 kg/cm$^2$ and 160° C. This pre-press process could exhaust the gas generated from vaporized moisture or from some volatile ingredients in the PTC lamination structure. The pre-press process could also drive the air out of the PTC lamination structure. As the generated gas is exhausted, the mold is pressed for additional three minutes at 100 kg/cm$^2$, 160° C. After that, the press step is repeated once at 150 kg/cm$^2$, 160° C. for 3 minutes to form a PTC material layer.

Next, two metal foils (i.e., conductive layers) are in physical contact with the top surface and the bottom surface of the PTC material layer, in which the two metal foils are symmetrically placed upon the top surface and the bottom surface of the PTC material layer. Each metal foil may have a rough surface with plural nodules (not shown) to physically contact the PTC material layer. Two Teflon cloths (not shown) are placed upon the two metal foils, and then two steel plates (not shown) are placed upon the two Teflon cloths. As a result, all of the Teflon cloths and the steel plates are disposed symmetrically on the top and the bottom surfaces of the PTC material layer to form a multi-layered structure. The multi-layered structure is then pressed for three minutes at 60 kg/cm$^2$ and 180° C., and is then pressed at the same pressure and at room temperature for five minutes. After pressing, the multi-layered structure is subjected to electron beam or γ-ray (Cobalt 60) radiation to form a conductive composite module. The conductive composite module may be punched to form chip-type PTC device 11 or 21 of various shapes, and then two electrode leads are connected to the PTC device 11 or 21 and the insulating encapsulation layer wraps thereon to form a radial-leaded over-current protection device 10 or 20.

Table 2 shows the shape, area, thickness, resistivity of the PTC device and the hold current (Ih) of the radial-leaded over-current protection device of each of the embodiments and comparative examples. The PTC devices of Em 1, Em 2, Em 8, Em 9 and Comp 2 are of rectangular shapes. The PTC devices of Em 3-7 and Comp 1 are of circular shapes with a diameter "D." It can be seen from Table 2 that the resistivity values of Comp 1 and Comp 2 are larger than 0.55 Ω-cm, and the resistivity values of the PTC material layers of the radial-leaded over-current protection devices of Em 1-9 are less than 0.18 Ω-cm, or less than 0.15 Ω-cm or 0.12 Ω-cm in particular. The resistivity of Em 1-9 is much less than Comp 1 or 2 which use carbon black as conductive filler. Moreover, the values of hold current per unit area of the radial-leaded over-current protection devices of Em 1-9 at 25° C. are in the range of 0.027-0.3 A/mm$^2$, or may be 0.03 A/mm$^2$, 0.05 A/mm$^2$, 0.08 A/mm$^2$, 0.1 A/mm$^2$ or 0.2 A/mm$^2$, which is larger than those of the Comp 1 and Comp 2.

TABLE 2

| | Dimension (mm) | Area "A" (mm$^2$) | Thickness "B" (mm) | Resistivity (Ω-cm) | Ih (A) | Ih/"A" (A/mm$^2$) |
|---|---|---|---|---|---|---|
| Em 1 | 12.7 × 19.05 | 241.9 | 0.254 | 0.0086 | 9 | 0.0372 |
| Em 2 | 8.51 × 10.16 | 86.5 | 0.261 | 0.0087 | 5.05 | 0.0584 |
| Em 3 | D6.4 | 32.2 | 0.511 | 0.0743 | 1.63 | 0.0507 |
| Em 4 | D6.4 | 32.2 | 0.411 | 0.0077 | 5 | 0.1552 |
| Em 5 | D6.4 | 32.2 | 0.618 | 0.0082 | 4.6 | 0.1431 |
| Em 6 | D6.4 | 32.2 | 0.517 | 0.1159 | 1.28 | 0.0398 |
| Em 7 | D6.4 | 32.2 | 0.629 | 0.0089 | 5.4 | 0.1679 |
| Em 8 | 8 × 11 | 88 | 1.3 | 0.0062 | 2.6 | 0.0295 |
| Em 9 | 8 × 11 | 88 | 1.7 | 0.0073 | 2.7 | 0.0306 |
| Comp 1 | D6.4 | 33.5 | 0.365 | 0.5895 | 0.9 | 0.0268 |
| Comp 2 | 5.08 × 6.6 | 86.5 | 0.365 | 5895 | 1.85 | 0.0214 |

Table 3 shows the data of the shape, area, thickness of the PTC device and breakdown voltage of the radial-leaded over-current protection device of each of the embodiments and comparative examples. In practice, each of the upper and lower conductive layers of the PTC device has a thickness in the range of 0.0175-0.21 mm. For example, metal foils of 1 oz (0.035 mm thick) or 2 oz (0.07 mm thick) may be used for upper and lower conductive layers of the PTC device. As a result, the total thickness of the first and second conductive layers (upper and lower metal foils) of the PTC device is approximately 0.07 mm or 0.14 mm. A ratio of the PTC device thickness to the total thickness of the conductive layers may be in the range of 1.5 and 25. The thickness of the PTC device is in direct proportion to the insulation or voltage endurance performance. For the same composition, the thicker the PTC device (PTC material layer), the larger the breakdown voltage is. In Table 3, the breakdown voltage is about 10-130V, and the breakdown voltage per unit thickness is about 50-100 V/mm, and it may be 60 V/mm, 70 V/mm, 80 V/mm or 90 V/mm. In summary, the radial-leaded over-current protection device exhibits larger hold current per unit area, lower resistivity and superior voltage endurance behavior, and therefore it is suitably for miniaturization.

TABLE 3

| | Dimension (mm) | Area "A" (mm$^2$) | Thickness "B" (mm) | Breakdown voltage (V) | Breakdown voltage/B (V/mm) | Total thickness of conductive layers "C" (mm) | B/C |
|---|---|---|---|---|---|---|---|
| Em 1 | 12.7 × 19.05 | 241.9 | 0.254 | 11.3 | 64.9 | 0.14 | 1.81 |
| Em 2 | 8.51 × 10.16 | 86.5 | 0.261 | 12.4 | 68.5 | 0.07 | 3.73 |
| Em 3 | D6.4 | 32.2 | 0.511 | 27.5 | 63.8 | 0.07 | 7.3 |
| Em 4 | D6.4 | 32.2 | 0.411 | 20.7 | 62.5 | 0.14 | 2.94 |
| Em 5 | D6.4 | 32.2 | 0.618 | 36.1 | 67.1 | 0.07 | 8.83 |
| Em 6 | D6.4 | 32.2 | 0.517 | 27.3 | 62.5 | 0.07 | 7.39 |
| Em 7 | D6.4 | 32.2 | 0.629 | 38.9 | 70.9 | 0.07 | 8.99 |
| Em 8 | 8 × 11 | 88 | 1.3 | 92 | 70.7 | 0.07 | 18.57 |
| Em 9 | 8 × 11 | 88 | 1.7 | 118 | 69.4 | 0.07 | 24.2 |

Table 4 shows the dimensions, resistances and the material of electrode leads of the embodiments. Em 1, Em 2, Em 4, Em 5, Em 7, Em 8 and Em 9 use electrode leads each having a diameter of 0.81 mm, and a length of 30 mm. The electrode lead of a diameter of 0.81 mm has a cross-sectional area of 0.52 $mm^2$, and a resistance of 1.05 mΩ. The PTC device having smaller hold current would use thinner electrode leads. For example, Em 3 and Em 6 use electrode leads having a diameter of 0.51 mm, which corresponds to a cross-sectional area of 0.2 $mm^2$. In general, the electrode lead has a cross-sectional of 0.16-1 $mm^2$ and a length of 25-35 mm. Accordingly, the length of the electrode lead divided by its cross-sectional area is about 20-300 $mm^{-1}$, and it may be 50 $mm^{-1}$, 100 $mm^{-1}$, 150 $mm^{-1}$, 200 $mm^{-1}$ or 250 $mm^{-1}$ in particular. The electrode leads may use tin-plated copper wires in consideration of low resistance. In practice, the resistance of the electrode lead may be less than 3 mΩ, and it may be less than 2.5 mΩ, 2 mΩ, or 1.2 mΩ to limit the entire resistance of the radial-leaded over-current protection device. The electrode lead is usually of a circular cross-sectional area; however, other shapes such as rectangular shape can be used if needed. The Larger the diameter or cross-sectional area of the electrode lead, the smaller the resistance is. The electrode lead of a larger diameter is more costly, but smaller diameter may not be able to withstand large hold current. To withstand hold current, the PTC device of larger hold current is usually associated with electrode leads of a larger diameter. The electrode leads may use copper, iron, alloy or mixture thereof. The electrode leads may be further plated with tin such as tin-plated copper wire or tin-plated iron-cored copper wire to prevent oxidation and increase solderability.

TABLE 4

| | Cross-sectional area ($mm^2$) | Length (mm) | Resistance (mΩ) | Material |
|---|---|---|---|---|
| Em 1 | 0.52 | 30 | 1.05 | Tin-plated copper wire |
| Em 2 | 0.52 | 30 | 1.05 | Tin-plated copper wire |
| Em 3 | 0.2 | 30 | 2.73 | Tin-plated copper wire |
| Em 4 | 0.52 | 30 | 1.05 | Tin-plated copper wire |
| Em 5 | 0.52 | 30 | 1.05 | Tin-plated copper wire |
| Em 6 | 0.2 | 30 | 2.73 | Tin-plated copper wire |
| Em 7 | 0.52 | 30 | 1.05 | Tin-plated copper wire |
| Em 8 | 0.52 | 30 | 1.05 | Tin-plated copper wire |
| Em 9 | 0.52 | 30 | 1.05 | Tin-plated copper wire |

As mentioned above, the diameter of the electrode lead is in direct proportion to hold current. For a PTC device with larger hold current, it is necessary to select the electrode leads of a larger diameter. However, the electrode lead of a larger diameter is more expensive; therefore excessively large diameter would not be effective for manufacturing cost control. According to the present application, the cross-sectional area of the electrode lead and the hold current has corresponding relationships as given below. When the hold current of the radial-leaded over-current protection device at 25° C. is 0.05-2.4 A, each of the first and second electrode leads has a cross-sectional area of at least 0.16 $mm^2$. When the hold current of the radial-leaded over-current protection device at 25° C. is 2.5-11.9 A, each of the first and second electrode leads has a cross-sectional area of at least 0.5 $mm^2$. When the hold current of the radial-leaded over-current protection device at 25° C. is 12-16 A, each of the first and second electrode leads has a cross-sectional area of at least 0.8 $mm^2$. For example, if the hold current of the radial-leaded over-current protection device at 25° C. is 0.05-2.4 A, each of the first and second electrode leads has a cross-sectional area of 0.16-0.41 $mm^2$, corresponding to a circular wire of a diameter of 0.46-0.72 mm, such as the wires in compliance with AWG (American Wire Gauge) 25, AWG 24, AWG 23, AWG 22 or AWG 21. If the hold current of the radial-leaded over-current protection device at 25° C. is 2.5-11.9 A, each of the first and second electrode leads has a cross-sectional area of 0.5-0.65 $mm^2$, corresponding to a circular wire of a diameter of 0.8-0.91 mm, such as the wire of AWG 20 or AWG 19. When the hold current of the radial-leaded over-current protection device at 25° C. is 12-16 A, each of the first and second electrode leads has a cross-sectional area of at 0.8-1 $mm^2$, corresponding to a circular wire of a diameter of greater than 1.01 mm, such as the wire of AWG 18 or AWG 17.

Because the radial-leaded over-current protection device may undergo large current, the solder connecting the electrode leads to the PTC device should have higher melting point such as greater than 190° C. or 225° C. The melting point of the solder may be 200° C., 210° C. or 220° C. in particular. The solder may use Sn, Sn—Ag, Su—Cu, Sn—Sb, Sn—Bi, Sn—Ag—Cu, Sn—Cu—Bi, Sn—Ag—Cu—Sb, Sn—Ag—Cu—Bi series.

In practice, the radial-leaded over-current protection device has a resistance less than 100 mΩ, or less than 50 mΩ or 20 mΩ in particular. The hold current divided by the area of the PTC device is about 0.027-0.3 A/$mm^2$. According to the data of the embodiments, the hold current and the area of the PTC device has the following relationship. The hold current is equal to $k1+A\times k2$, where k1=0.9-6 A, k2=0.01-0.03 A/$mm^2$ and A is the area of the PTC device in square millimeter.

The crystalline polymer usually comprises HDPE, and may further comprise a polymer with a lower melting point (e.g., LDPE) for low-temperature protection so as to ensure the device will trip at a relatively low temperature. LDPE may be polymerized using Ziegler-Natta catalyst, Metallocene catalyst or other catalysts, or can be copolymerized by vinyl monomer or other monomers such as butane, hexane, octene, acrylic acid, or vinyl acetate. In an embodiment, to achieve over-current protection at high temperature or a specific objective, the compositions of the PTC material layer may totally or partially use crystalline polymer with high melting point; e.g., PVDF (polyvinylidene fluoride), PVF (polyvinyl fluoride), PTFE (polytetrafluoroethylene), or PCTFE (polychlorotrifluoro-ethylene).

The above crystalline polymer can also comprise a functional group such as an acidic group, an acid anhydride group, a halide group, an amine group, an unsaturated group, an epoxide group, an alcohol group, an amide group, a metallic ion, an ester group, and acrylate group, or a salt group.

The conductive ceramic filler may comprise titanium carbide (TiC), tungsten carbide (WC), vanadium carbide (VC), zirconium carbide (ZrC), niobium carbide (NbC), tantalum carbide (TaC), molybdenum carbide (MoC), hafnium carbide (HfC), titanium boride ($TiB_2$), vanadium boride ($VB_2$), zirconium boride ($ZrB_2$), niobium boride ($NbB_2$), molybdenum boride ($MoB_2$), hafnium boride ($HfB_2$), zirconium nitride (ZrN), titanium nitride (TiN). The conductive filler may be mixture, solid solution or core-shell structure of the aforesaid conductive ceramic filler. The conductive ceramic filler have a particle size of 0.01-30 μm, or preferably 0.1-10 μm. The conductive ceramic filler has an aspect ratio of below 100, or preferably below 20 or 10. In practice, conductive ceramic filler may be of spherical shape, cubic shape, flake, polygonal shape or column shape.

In addition, an antioxidant, a cross-linking agent, a flame retardant, a water repellent, or an arc-controlling agent can be added into the PTC material layer to improve the material polarity, electric property, mechanical bonding property or other properties such as waterproofing, high-temperature resistance, cross-linking, and oxidation resistance. For example, Comp 1 and Comp 2 in Table 1 further add non-conductive filler such as magnesium hydroxide. Instead, the non-conductive filler may comprise magnesium oxide, aluminum oxide, aluminum hydroxide, boron nitride, aluminum nitride, calcium carbonate, magnesium sulfate and barium sulfate or the mixture thereof. The particle size of the non-conductive filler is mainly between 0.05 μm and 50 μm, and the non-conductive filler is 1% to 15% by weight of the composition of the PTC material layer.

Because the PTC material layer of the PTC device would expand when current flows therethrough, the insulating encapsulation layer wrapping the PTC device is limited to specific material to withstand the expansion of the PTC material layer. If the expansion rate of the PTC material layer is greater than the expansion rate of the insulating encapsulating layer, the insulating encapsulating layer may crack. Therefore, the thermal expansion coefficient of the insulating encapsulation layer has to be equal to or greater than the thermal expansion coefficient of the PTC material layer. The insulating encapsulation layer may use epoxy, silicone, silicon rubber or polyurethane, of which the glass transition temperature (Tg) is less than the melting point of the crystalline polymer of the PTC material layer in the consideration of thermal expansion.

The radial-leaded over-current protection device of the present application uses conductive filler of low resistivity and electrode leads of low resistance to obtain low resistance and large hold current. The present invention is suitable for miniaturization of passive devices or the applications in need of low resistance and large hold current. Moreover, the radial-leaded over-current protection device exhibits higher breakdown voltage per unit thickness in comparison with the one using conductive metal filler, and therefore has good voltage endurance.

The above-described embodiments of the present application are intended to be illustrative only. Numerous alternative embodiments may be devised by persons skilled in the art without departing from the scope of the following claims.

We claim:

1. A radial-leaded over-current protection device, comprising:

a PTC device comprising a first conductive layer, a second conductive layer and a PTC material layer sandwiched between the first and second conductive layers, the PTC material layer having a resistivity less than 0.18 Ω-cm, and comprising crystalline polymer and conductive ceramic filler dispersed therein; the conductive ceramic filler has a resistivity less than 500μΩ-cm and comprises 35% to 65% by volume of the PTC material layer;

a first electrode lead of which one end connects to the first conductive layer;

a second electrode lead of which one end connects to the second conductive layer; and an insulating encapsulation layer wrapping the PTC device and the ends of the first and second electrode leads connecting to the PTC device;

wherein the radial-leaded over-current protection device has a resistance less than 100 mΩ, and the radial-leaded over-current protection device, at 25° C., indicates that hold current thereof divided by an area of the PTC device is in the range of 0.027-0.3 A/mm$^2$;

wherein each of the first and second electrode leads has a cross-sectional area of at least 0.16 mm$^2$ if the hold current of the radial-leaded over-current protection device at 25° C. is 0.05-2.4 A; each of the first and second electrode leads has a cross-sectional area of at least 0.5 mm$^2$ if the hold current of the radial-leaded over-current protection device at 25° C. is 2.5-11.9 A; and each of the first and second electrode leads has a cross-sectional area of at least 0.8 mm$^2$ if the hold current of the radial-leaded over-current protection device at 25° C. is 12-16 A.

2. The radial-leaded over-current protection device of claim 1, wherein the PTC device has a thickness of 0.2-2 mm.

3. The radial-leaded over-current protection device of claim 1, wherein the first or second conductive layer has a thickness of 0.0175-0.21 mm.

4. The radial-leaded over-current protection device of claim 1, wherein a ratio of a thickness of the PTC device to a total thickness of the first and second conductive layers is in the range of 1-30.

5. The radial-leaded over-current protection device of claim 1, wherein the PTC device has an area less than 300 mm$^2$.

6. The radial-leaded over-current protection device of claim 1, wherein the hold current is equal to k1+A×k2, where k1=0.9-6 A, k2=0.01-0.03 A/mm$^2$ and A is an area of the PTC device in square millimeter.

7. The radial-leaded over-current protection device of claim 1, wherein the insulating encapsulation layer comprises polymer having a glass transition temperature less than a melting point of the crystalline polymer.

8. The radial-leaded over-current protection device of claim 1, wherein a solder connecting the first and second electrode leads to the first and second conductive layers has a melting point greater than 190° C.

9. The radial-leaded over-current protection device of claim 1, wherein each of the first and second electrode leads has a resistance less than 3 mΩ.

10. The radial-leaded over-current protection device of claim 1, wherein the conductive ceramic filler comprises titanium carbide, tungsten carbide, vanadium carbide, zirconium carbide, niobium carbide, tantalum carbide, molybdenum carbide, hafnium carbide, titanium boride, vanadium boride, zirconium boride, niobium boride, molybdenum boride, hafnium boride, zirconium nitride, titanium nitride, or mixture, solid solution, or core-shell structure thereof.

11. The radial-leaded over-current protection device of claim 1, wherein a breakdown voltage of the radial-leaded over-current protection divided by a thickness of the PTC device is 50-100 kV/mm.

12. The radial-leaded over-current protection device of claim 1, wherein the radial-leaded over-current protection device has a resistance less than 50 mΩ.

13. The radial-leaded over-current protection device of claim 1, wherein at least one of the first and second electrode leads has a cross-sectional area of 0.16-1 A/mm$^2$.

14. The radial-leaded over-current protection device of claim 1, wherein a length of the first or second electrode lead divided by a cross-sectional area thereof is 20-300 mm$^{-1}$.

15. The radial-leaded over-current protection device of claim 1, wherein the first and second electrode leads use copper, iron, alloy or combination thereof, or tin-plated wires.

16. The radial-leaded over-current protection device of claim 1, wherein the PTC material layer is irradiated by electron beam or γ-ray.

* * * * *